US008213841B2

(12) United States Patent
Kitagawa et al.

(10) Patent No.: US 8,213,841 B2
(45) Date of Patent: Jul. 3, 2012

(54) CONTAINER AND DEVICE

(75) Inventors: Hiroaki Kitagawa, Ebina (JP); Kei Hirata, Ebina (JP); Kouji Fukumuro, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 545 days.

(21) Appl. No.: 12/408,817

(22) Filed: Mar. 23, 2009

(65) Prior Publication Data

US 2010/0054817 A1 Mar. 4, 2010

(30) Foreign Application Priority Data

Aug. 29, 2008 (JP) ..... 2008-221569
Aug. 29, 2008 (JP) ..... 2008-221570

(51) Int. Cl.
*G03G 15/08* (2006.01)

(52) U.S. Cl. ..... 399/262; 399/120; 399/252; 399/260; 220/345.2; 220/345.3; 222/325; 347/140; 347/158

(58) Field of Classification Search ..... 399/119, 399/120, 252, 258–262; 222/DIG. 1, 325; 220/345.2, 345.3, 351, 345.4; 347/140, 158; D18/43
See application file for complete search history.

(56) References Cited

U.S. PATENT DOCUMENTS

| | | | | |
|---|---|---|---|---|
| 5,449,095 | A * | 9/1995 | Kobayashi | 222/325 |
| 5,933,691 | A | 8/1999 | Johroku | 399/262 |
| D636,813 | S * | 4/2011 | Kikuchi et al. | D18/43 |
| 2007/0081834 | A1 * | 4/2007 | Koyama et al. | 399/258 |

FOREIGN PATENT DOCUMENTS

| | | | |
|---|---|---|---|
| EP | 0 843 233 | A2 | 5/1998 |
| EP | 1 772 782 | A2 | 4/2007 |
| EP | 2 060 954 | A1 | 5/2009 |
| JP | 04-260076 | | 9/1992 |
| JP | 10-142915 | | 5/1998 |
| JP | 2003-255686 | | 9/2003 |
| JP | 2005-134452 | | 5/2005 |
| JP | 2006-133459 | | 5/2006 |

* cited by examiner

*Primary Examiner* — David Porta
*Assistant Examiner* — Jessica L Eley
(74) *Attorney, Agent, or Firm* — Morgan, Lewis & Bockius LLP

(57) ABSTRACT

A container includes: a container body that is to be inserted into the device, and that has a port; and a pair of support members arranged so that the support members face each other across the port, that supports a cover for covering the port, the cover including: a covering portion that covers the port; a pair of supported members that are supported by the support members; and a pair of connecting portions arranged so that the connecting portions face each other, that connects the covering portion and the supported members, and at least one of the connecting members being configured so that the connecting member becomes narrow as an outside surface of the connecting member tapers towards its inside surface at an end of the container body inserted into the device.

9 Claims, 15 Drawing Sheets

CONTAINER AND DEVICE

CROSS-REFERENCE TO RELATED APPLICATIONS

This application is based on and claims priority under 35 USC 119 from Japanese Patent Application No. 2008-221569 filed on Aug. 29, 2008 and Japanese Patent Application No. 2008-221570 filed on Aug. 29, 2008.

BACKGROUND

1. Technical Field

The present invention relates to a container and a device.

2. Related Art

An electrophotographic image-forming device has a toner cartridge storing developer used for forming an image, and such a toner cartridge can be replaced by a user. Some toner cartridges are configured not to allow developer to leak when the toner cartridge is not attached to an image-forming device.

SUMMARY

An aspect of the present invention provides a container including: a container body that stores supplies to be provided to a device, that is to be inserted into the device, and that has a port out of which the supplies flow; and a pair of support members arranged so that the support members face each other across the port, that supports an openable and closable cover for covering the port so that the openable and closable cover is able to move between a closed position at which the port is covered and an open position at which the port is exposed, the openable and closable cover including: a covering portion that covers the port at the close position; a pair of supported members that are supported by the support members; and a pair of connecting portions arranged so that the connecting portions face each other, that connects the covering portion and the supported members, and at least one of the connecting members being configured so that the connecting member becomes narrow as an outside surface of the connecting member tapers towards its inside surface at an end of the container body inserted into the device.

BRIEF DESCRIPTION OF THE DRAWINGS

Exemplary embodiments of the present invention will be described in detail below with reference to the following figures, wherein.

DETAILED DESCRIPTION

[Exemplary Embodiment]

(Configuration of Image-Forming Device)

Figure 1:
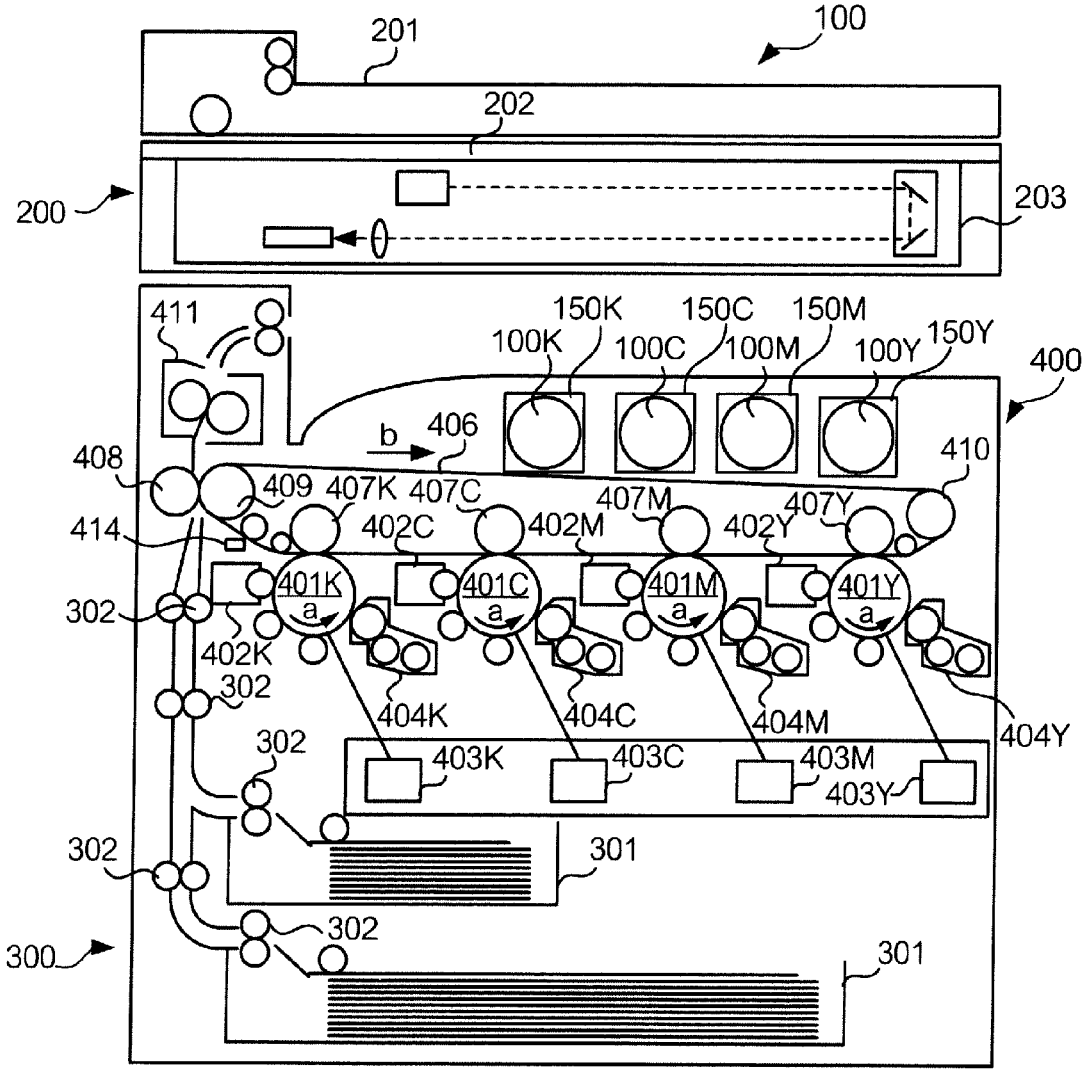
FIG. 1 is a view showing a configuration of image-forming device 1 according to an exemplary embodiment of the present invention.

FIG. 1 is a view showing a configuration of image-forming device 1 according to an exemplary embodiment of the present invention. Image-forming device 1 is an electrophotographic image-forming device that forms a color image on a sheet using toner (developer) of yellow (Y), magenta (M), cyan (C), and black (K). Image-forming device 1 includes image-reading unit 200, sheet-feeding unit 300, and image-forming unit 400.

It is to be noted that in the drawings and the following description, a character "Y" is attached to the end of a sign representing a component relating to an image of yellow, a character "M" is attached to the end of a sign representing a component relating to an image of magenta, a character "C" is attached to the end of a sign representing a component relating to an image of cyan, and a character "K" is attached to the end of a sign representing a component relating to an image of black.

Image reading unit 200 is a unit for reading an image of a document, which includes automatic sheet feeding device 201, platen glass 202, and reading device 203. Automatic sheet feeding device 201 is a device for conveying documents onto platen glass 202, which conveys documents placed on the device onto platen glass one by one. Reading unit 203 is a device for reading an image of a document placed on platen glass 202, which irradiates light to a document placed on platen glass 202, and converts light reflected by the document into electrical signals using a photoelectric conversion element. Reading unit 203 generates, on the basis of the electrical signals, image data representing images of the document of Y, M, C, and K, and outputs the image data to image-forming unit 400.

Sheet-feeding unit 300 includes plural sheet storage units 301 for storing sheets and plural transport rolls 302 for transporting a sheet, which transport a sheet stored in sheet-storage unit 301 to image-forming unit 400.

Image-forming unit 400 includes a photoreceptor that rotates in the direction of arrow a of FIG. 1, and on which an electrostatic latent image is formed, for each color of Y, M, C, and K (photoreceptors 401Y, 401M, 401C, and 401K).

Image-forming unit 400 also includes charging devices 402Y, 402M, 402C, and 402K for charging a photoreceptor, and exposure devices 403Y, 403M, 403C, and 403K for emitting laser light to a photoreceptor on the basis of provided image data, thereby forming an electrostatic latent image according to the image data on the photoreceptor.

Image-forming unit 400 also includes developing devices 404Y, 404M, 404C, and 404K for developing an electrostatic latent image formed on a photoreceptor, using supplies such as toner, and toner cartridges 100Y (which stores toner of yellow), 100M (which stores toner of magenta), 100C (which stores toner of cyan), and 100K (which stores toner of black) which are examples of a container storing toner to be used in developing devices 404Y, 404M, 404C, and 404K.

Toner cartridges 100Y, 100M, 100C, and 100K are attached to toner cartridge docking units 150Y, 150M, 150C, and 150K which are provided for each toner cartridge, respectively, and toner stored in each toner cartridge is transported to developing device 404Y, 404M, 404C, or 404K via a toner path (not shown) connecting a toner cartridge docking unit and a developing device.

Image-forming unit 400 also includes: intermediate transfer belt 406 hung on back-up roll 409 and driving roll 410 and kept tense, that rotates in the direction of arrow b of FIG. 1 while contacting photoreceptors 401Y, 401M, 401C, and 401K; first transfer rolls 407Y, 407M, 407C, and 407K that face photoreceptors 401Y, 401M, 401C, and 401K, respectively, via intermediate transfer belt 406, and transfer a toner image formed on a peripheral surface of a photoreceptor to intermediate transfer belt 406; second transfer roll 408 that faces back-up roll 409 via intermediate transfer belt 406, and transfers a toner image formed on intermediate transfer belt 406 to a sheet; and fixing device 111 that applies heat and pressure to a toner imaged transferred to a sheet, thereby fixing the toner image on the sheet.

(Operation of Image-Forming Device 1)

When a document is reproduced in image-forming device 1, a document placed on automatic sheet feeding device 201 is transported onto a surface of platen glass 202. Reading device 203 reads an image of the document placed on platen glass 202, generates image data representing the read image for each color of Y, M, C, and K, and sends the generated pieces of image data to image-forming unit 400.

Image-forming unit 400 causes each developing device to charge a corresponding photoreceptor, and sends the provided pieces of image data to corresponding developing devices. Each developing device emits laser light to a corresponding photoreceptor in accordance with provided image data, thereby forming an electrostatic latent image corresponding to an image of color of Y, M, C, or K on the photoreceptor.

Subsequently, toner provided from a toner cartridge to a developing device is provided from the developing device to a photoreceptor, and in each photoreceptor, the electrostatic latent image is developed so that a toner image is formed on the surface of the photoreceptor. The toner image is transferred to intermediate transfer belt 406 by a first transfer roll corresponding to a photoreceptor.

Subsequently, image-forming unit 400 causes intermediate transfer belt 406 to rotate so that the toner image transferred onto intermediate transfer belt 406 reaches a position at which second transfer roll 408 is located. At this position, a sheet transported from sheet storage unit 301 by transport rolls 302 is transported into a space between second transfer roll 408 and intermediate transfer belt 406, and the toner image transferred onto intermediate transfer belt 406 is transferred to the sheet by second transfer roll 408 and back-up roll 409. Subsequently, the sheet with the toner image is transported into fixing device 411, and the toner image is fixed by fixing device 411, and the sheet is thereafter ejected from image-forming device 1.

As described above, in image-forming device 1, toner stored in a toner cartridge is used to form an image on a sheet, and if toner stored in a toner cartridge dries up, it is necessary to remove the toner cartridge with no toner from image-forming unit 400, and attach a new toner cartridge to image-forming unit 400.

Now, an operation of attaching and removing of a toner cartridge, and a toner cartridge and a toner cartridge docking unit according to the present exemplary embodiment will be described.

(Configuration of Toner Cartridge and Toner Cartridge Docking Unit)

A toner cartridge and a toner cartridge docking unit according to the present exemplary embodiment will be described. Please note that since the configurations of toner cartridges 100Y, 100M, 100C, and 100K are identical with each other, and the configurations of toner cartridge docking units 150Y, 150M, 150C, and 150K are identical with each other, as an example, the configurations of only toner cartridge 100Y and toner cartridge docking unit 150Y will be described, and a description relating to the configurations of the other toner cartridges and the other toner cartridge docking units will be omitted.

(Configuration of Toner Cartridge 100Y)

Figure 2:
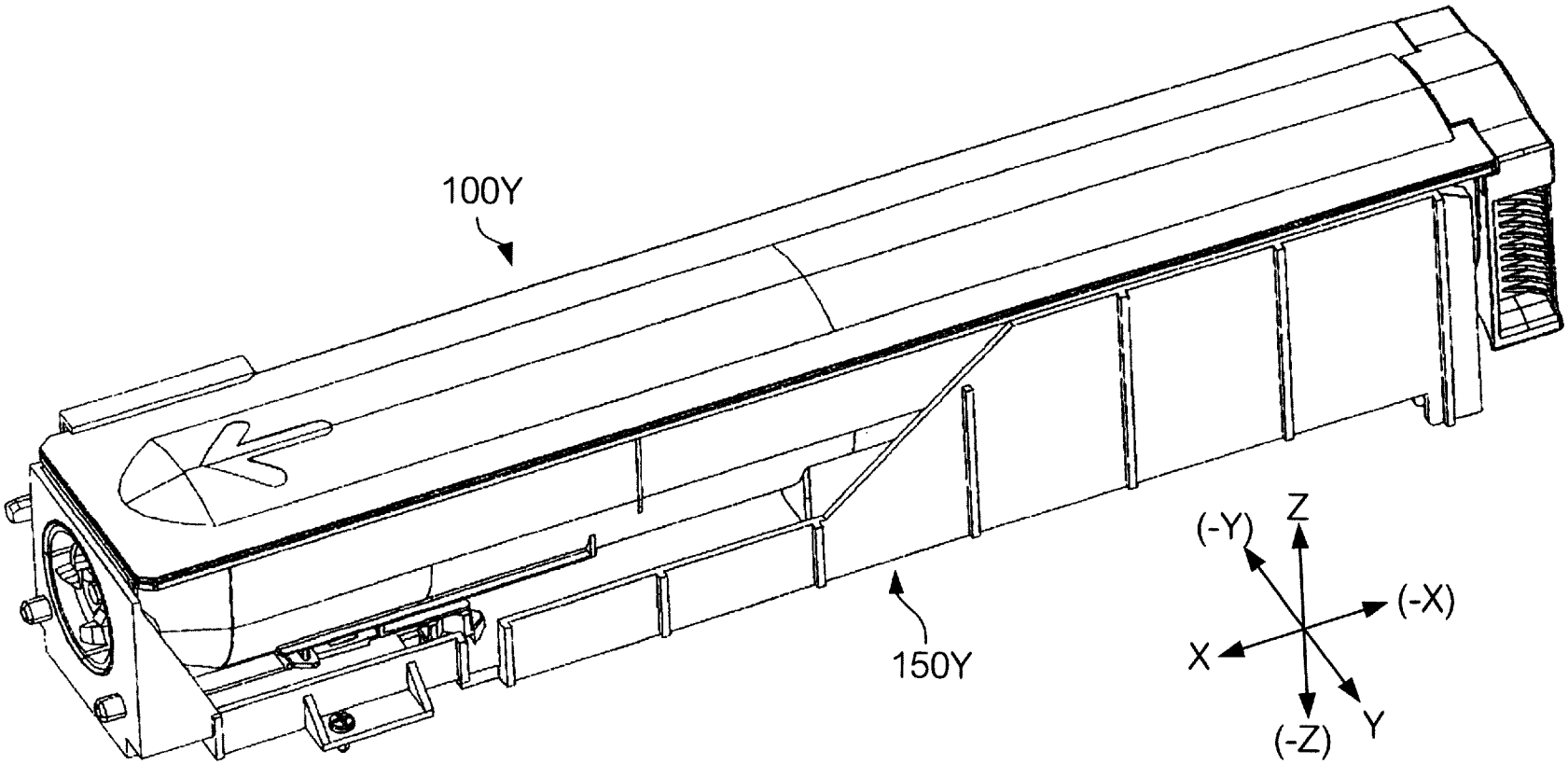
FIG. 2 is an external view showing toner cartridge 100Y according to the same exemplary embodiment, attached to toner cartridge docking unit 150Y.

FIG. 2 is an external view showing toner cartridge 100Y according to the present exemplary embodiment, attached to toner cartridge docking unit 150Y. In the following description, to make the description easily understandable, X direction shown in the drawing is referred to as forward direction, −X direction as backward direction, Y direction as right direction, −Y direction as left direction, Z direction as upward direction, and −Z direction as downward direction. Alternatively, X direction is referred to as front side, −X direction as back side, Y direction as right side, −Y direction as left side, Z direction as upper side, and −Z direction as lower side.

Figure 3:
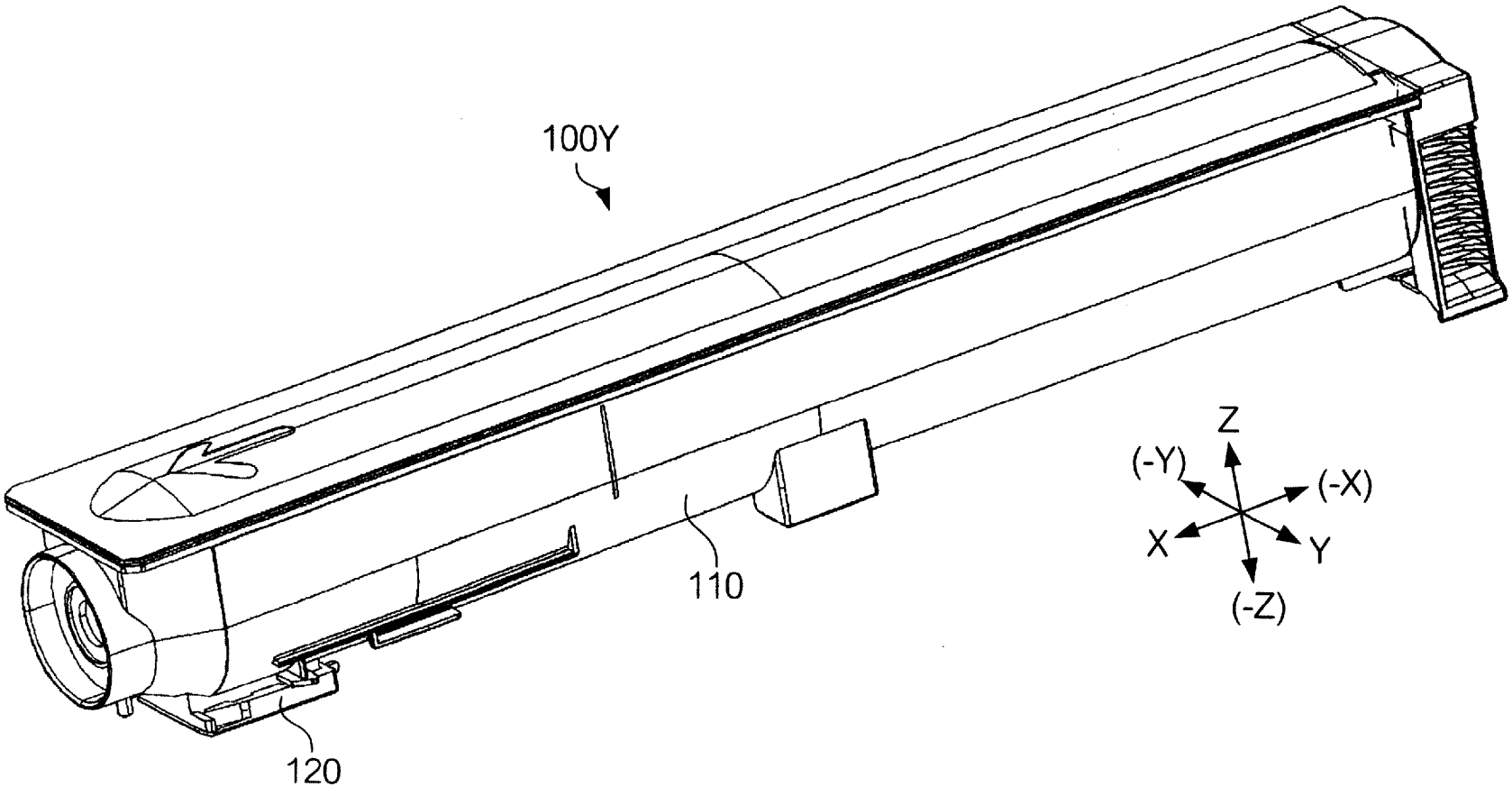
FIG. 3 is an external view showing toner cartridge 100 Y.
Figure 4:
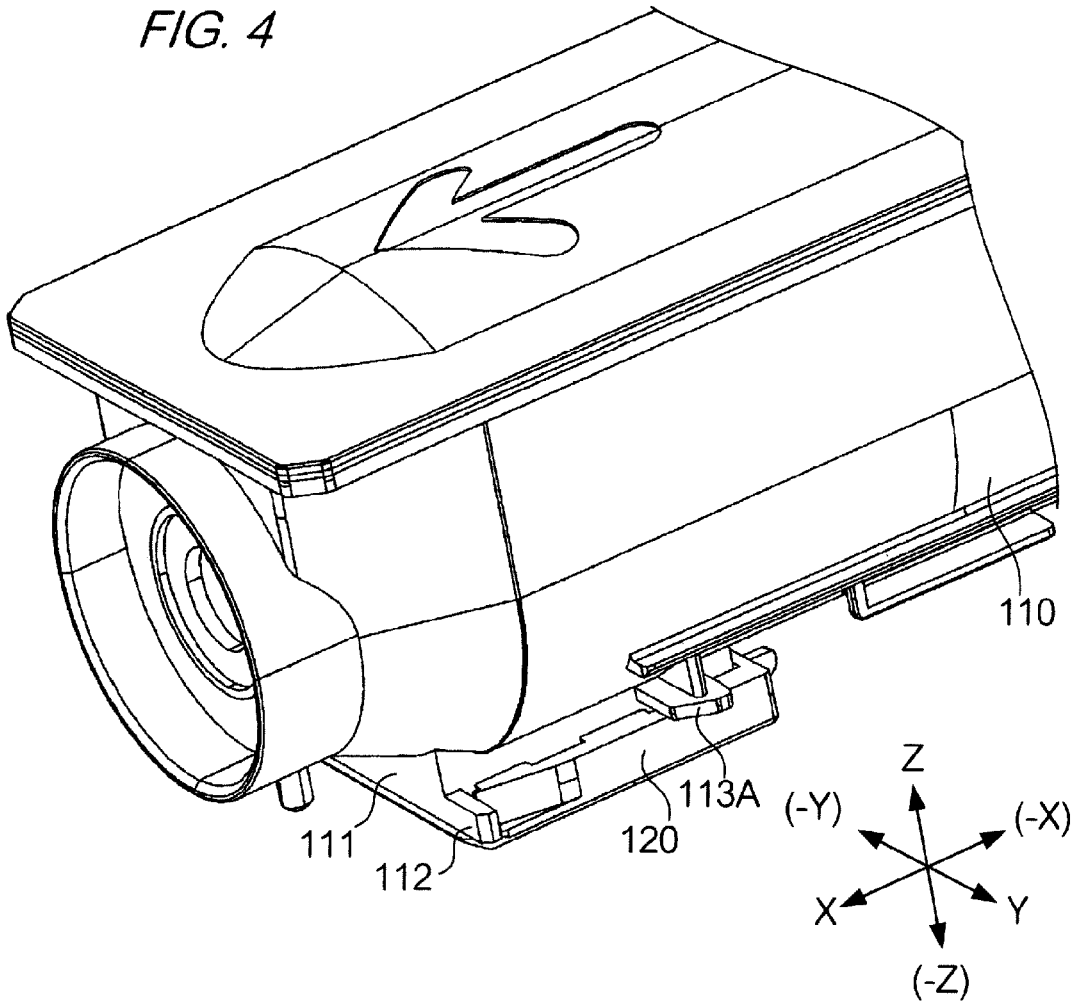
FIG. 4 is an enlarged view showing the front side of toner cartridge 100Y.
Figure 5:
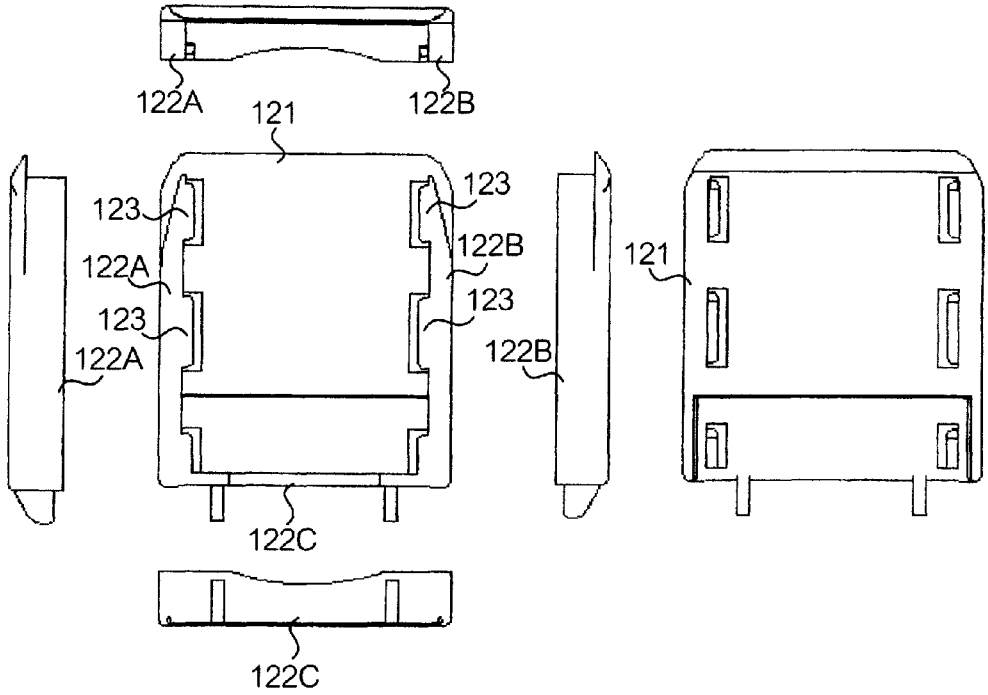
FIG. 5 is six orthogonal views showing shutter 120.
Figure 6:
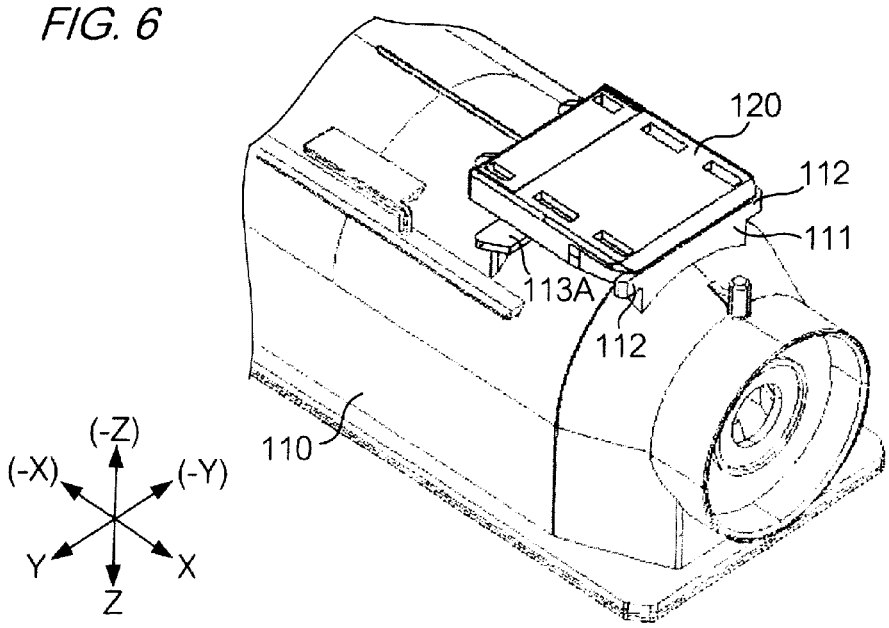
FIG. 6 is an enlarged view showing a structure around opening 115 that is closed by shutter 120.
Figure 7:
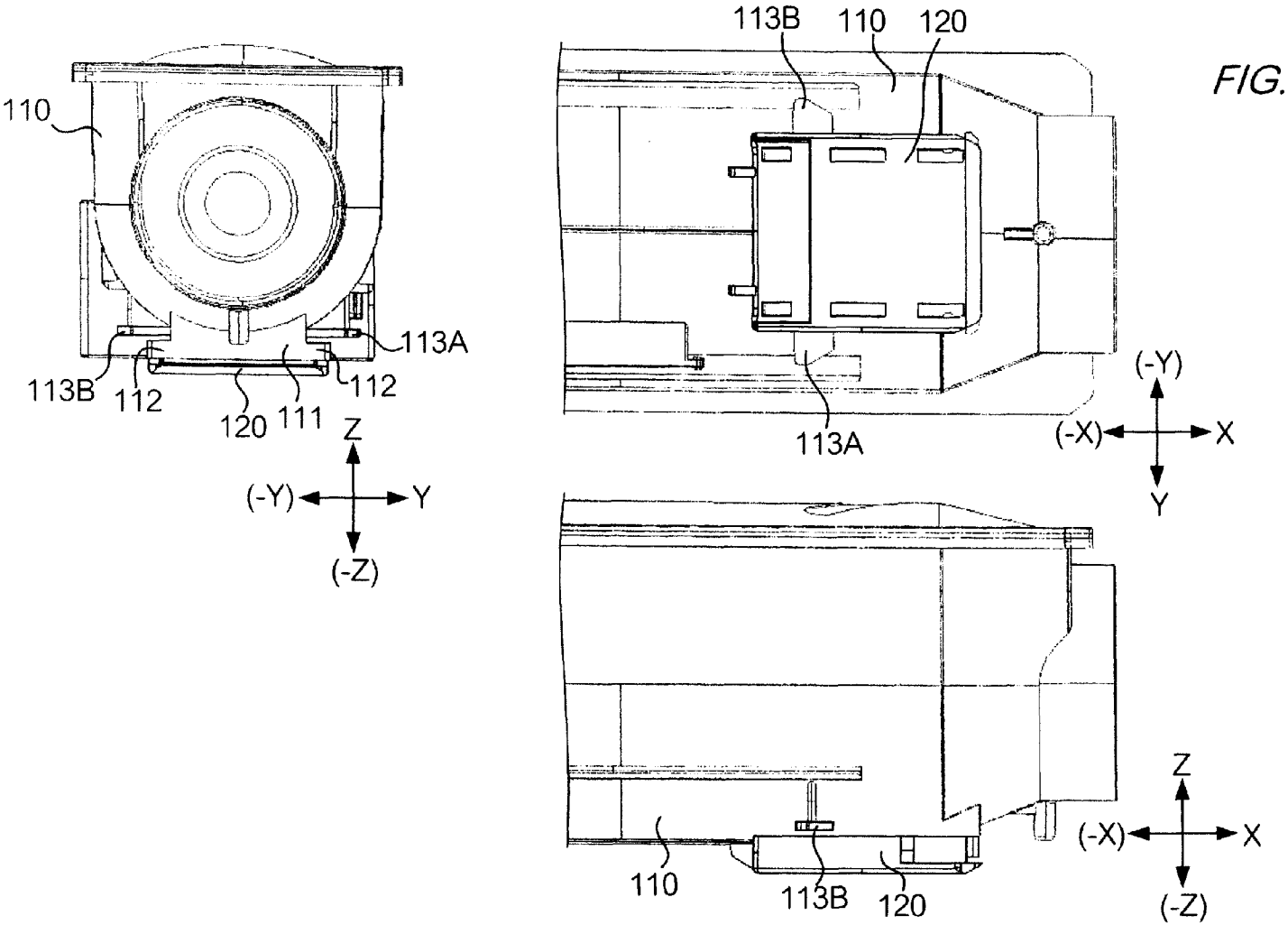
FIG. 7 is three orthogonal views showing a structure around opening 115 that is closed by shutter 120.
Figure 8:
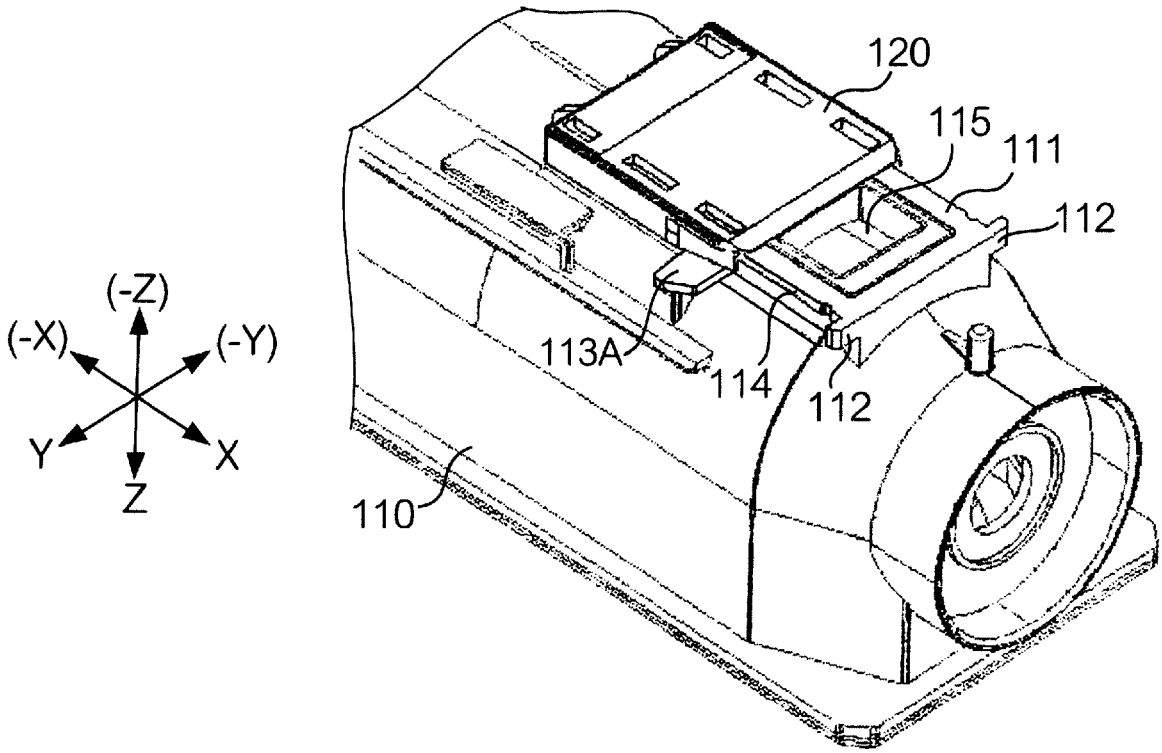
FIG. 8 is an enlarged view showing a structure around opening 115 that is not closed by shutter 120.
Figure 9:
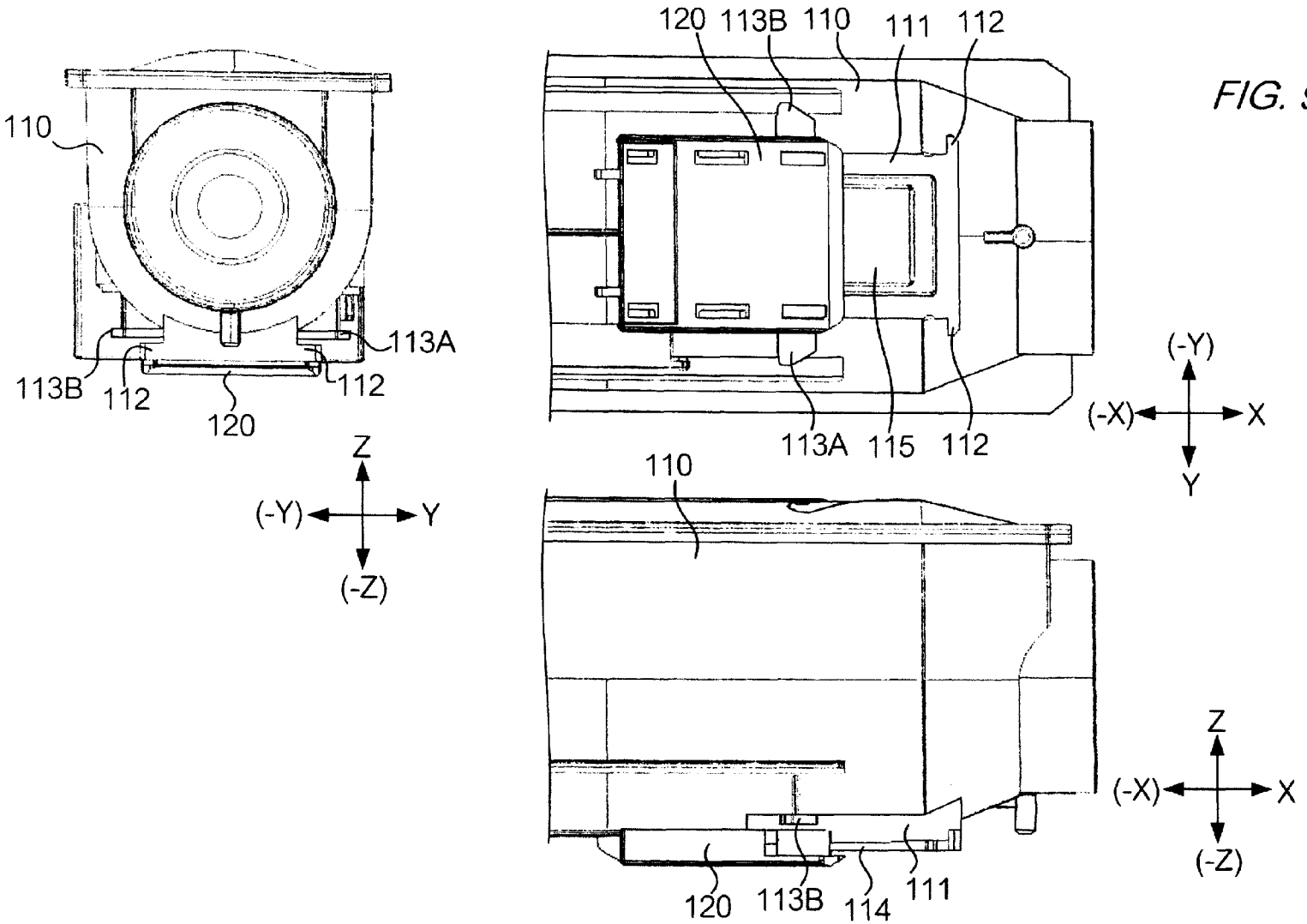
FIG. 9 is three orthogonal views showing a structure around opening 115 that is not closed by shutter 120.

FIG. 3 is an external view showing toner cartridge 100Y. FIGS. 4, 6, and 8 are enlarged views showing the front side of toner cartridge 100Y. FIG. 5 is six orthogonal views showing shutter 120. FIGS. 7 and 9 are three orthogonal views showing the front side of toner cartridge 100Y.

As shown in the drawings, toner cartridge 100Y includes toner container 110 which is an example of a container body for storing toner and shutter 120 which is an example of an openable and closable cover.

Toner container 110 is a tubular-shaped hollow container with a toner storage chamber (not shown), which stores toner. In the lower side of the front end portion of toner container 110, there are provided opening 115 which is an example of an outlet head out of which toner stored in a toner storage chamber flows and frame member 111 with a pair of guide members 114 which are examples of a support member for supporting shutter 120 so that it is able to move relative to opening 115. In the present exemplary embodiment, opening 115 takes the shape of a rectangle; however, opening 115 may take other shapes such as a polygon or an ellipse.

A pair of guide members 114 is provided so that they sandwich opening 115. A guide member provided on the lower side portion of the right side surface of frame member 111 protrudes in the right direction, and a guide member provided on the lower side portion of the left side surface of frame member 111 protrudes in the left direction.

In the front side of frame member 111, there are provided projection portions 112, one of which protrudes in the right direction, and the other of which protrudes in the left direction, as shown in the drawings. Projection portions are examples of a protective member for protecting side wall 122A or 122B (described later). Also, on the right side surface of frame member 111, arm-opening projection portion 113A is formed so that it protrudes in the right direction, and on the left side surface of frame member 111, arm-opening projection portion 113B is formed so that it protrudes in the left direction. Arm-opening projection portions 113A and 113B are formed so that the length in the horizontal direction becomes shorter from the back side to the front side, as shown in FIG. 7.

Projection portions 112 are arranged so that the position in the vertical direction, as viewed from the front side, overlaps that of a part of side wall 122A or 122B, and does not overlap that of an end of bottom wall 121 (described later) of shutter 120, to prevent side walls 122A and 122B of toner cartridge 100Y which is being inserted, from coming into contact with members provided inside image-forming device 1. It is preferable that projection portions 112 are arranged so that the left tip does not protrude relative to the left end of shutter 120, and the right tip does not protrude relative to the right end of shutter 120.

Shutter 120 is a member for covering opening 115, which is roughly formed by bottom wall 121 which is an example of a covering portion for covering opening 115, guided members 123 which are examples of a supported portion which is supported by guide member 114, side walls 122A and 122B, and back wall 122C which are examples of a connecting portion that connects bottom wall 121 and guided member 123.

Bottom wall 121 is a wany rectangle plate, whose front end portion becomes thinner in the vertical direction toward the edge, and whose width in the horizontal direction becomes narrower toward the front side.

In the back side of bottom wall 121, back wall 122C is integrally formed so that it extends from bottom wall 121. In the right side of bottom wall 121, side wall 122A is integrally formed so that it extends from bottom wall 121. In the left side of bottom wall 121, side wall 122B is integrally formed so that it extends from bottom wall 121.

In the upper side of side wall 122A, guided members 123 are integrally formed so that they protrude in the left direction relative to side wall 122A. In the upper side of side wall 122B, guided members 123 are integrally formed so that they protrude in the right direction relative to side wall 122B.

Side walls 122A and 122B are formed so that they become thinner in the horizontal direction toward the front side.

If shutter 120 is moved in the forward direction from the back side of frame 111, while the surface on which side walls are formed faces toner container 110, and the front side is directed to the forward direction, guide members 114 of frame member 111 enter a space between guided members 123 of side walls 122A and bottom wall 121. Shutter 120 is guided by guide members 114 of frame member 111 to cover opening 115 as shown in FIGS. 6 and 7. On the other hand, if shutter covering opening 115 is moved in the backward direction, shutter 120 is moved as guided by guide members 114, and as a result, the opening is exposed as shown in FIGS. 8 and 9.

(Configuration of Toner Cartridge Docking Unit 150Y)

Figure 10:
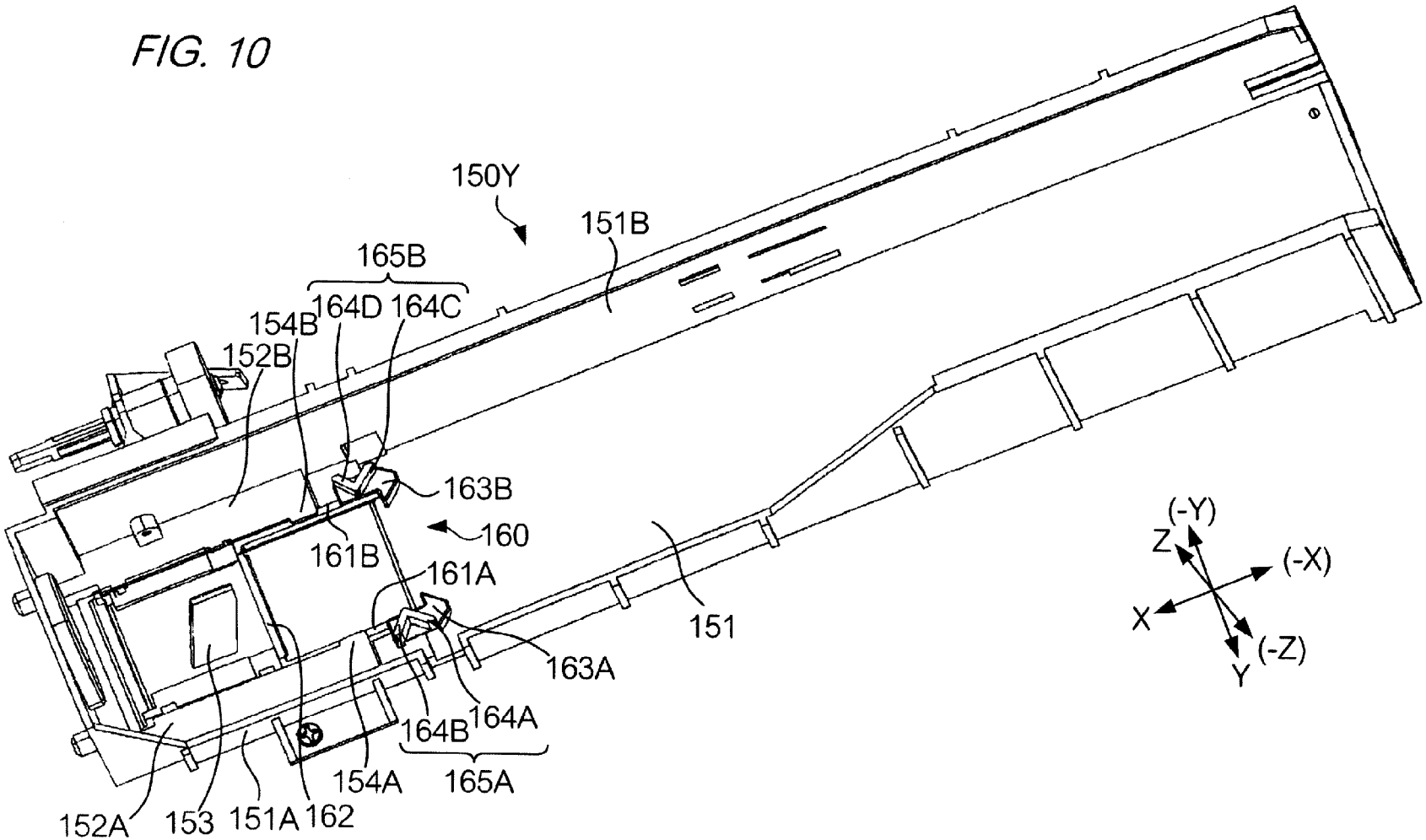
FIG. 10 is an external view showing toner cartridge docking unit 150Y according to the same exemplar embodiment.

FIG. 10 is an external view showing toner cartridge docking unit 150Y.

Toner cartridge docking unit 150Y includes a housing unit for housing toner cartridge 100Y, shutter fixing unit 160 which is an example of a fixing member for fixing shutter 120 when toner cartridge 100Y is housed in the housing unit, and prevention plates 152A and 152B which are examples of a prevention member for preventing arm members 161A and 161B of shutter fixing unit 160 from moving in the vertical direction.

The housing unit is broadly formed by bottom wall 151 and side walls 151A to 151C.

Bottom wall 151 has a rectangular form, which includes toner port 153 leading into a toner path, and toner port forming member 151D that is arranged so that it faces frame member 111 of toner cartridge 100Y housed in the housing unit, and that protrudes in the upper direction. In the front side of bottom wall 151, side wall 151C is integrally formed so that it extends from bottom wall 151. In the right side of bottom wall 151, side wall 151A is integrally formed so that it extends from bottom wall 151. In the left side of bottom wall 151, side wall 151B is integrally formed so that it extends from bottom wall 151.

In the left side of side wall 151A, prevention plate 152A is integrally formed so that it protrudes from side wall 151A in the left direction. In the right side of side wall 151B, prevention plate 152B is integrally formed so that it protrudes from side wall 151B in the right direction. Prevention plate 152A has salient 154A that projects in the left direction in the back end portion. Prevention plate 152B has salient 154B that projects in the right direction in the right direction in the back end portion. There is a space between prevention plate 152A and bottom wall 151, and between prevention plate 152B and bottom wall 151, in which a part of shutter fixing unit 160 is inserted and fixed.

Shutter fixing unit 160 includes elastically-deformable arm members 161A and 161B, and connecting member 162 that connects arm member 161A and arm member 161B. In the end of arm member 161A, hook-like shutter fixing member 163A that protrudes in the left direction is formed. In the end of arm member 161B, hook-like shutter fixing member 163B that protrudes in the right direction is formed.

On shutter fixing member 163A, arm opening member 165A is integrally formed so that it protrudes in the upper direction. Opening member 165A includes two walls 164A and 164B which are integrally formed, and form an angle with each other.

On shutter fixing member 163B, arm opening member 165B is integrally formed so that it protrudes in the upper direction. Opening member 165B includes two walls 164C and 164D which are integrally formed, and form an angle with each other. A dogleg formed by walls 164A and 164B points to the left, and a dogleg formed by walls 164C and 164D points to the right.

(Operation of Attaching Toner Cartridge)

An operation of attaching toner cartridge 100Y to toner cartridge docking unit 150Y will be described with reference to FIGS. 11 to 13.

Figure 11:
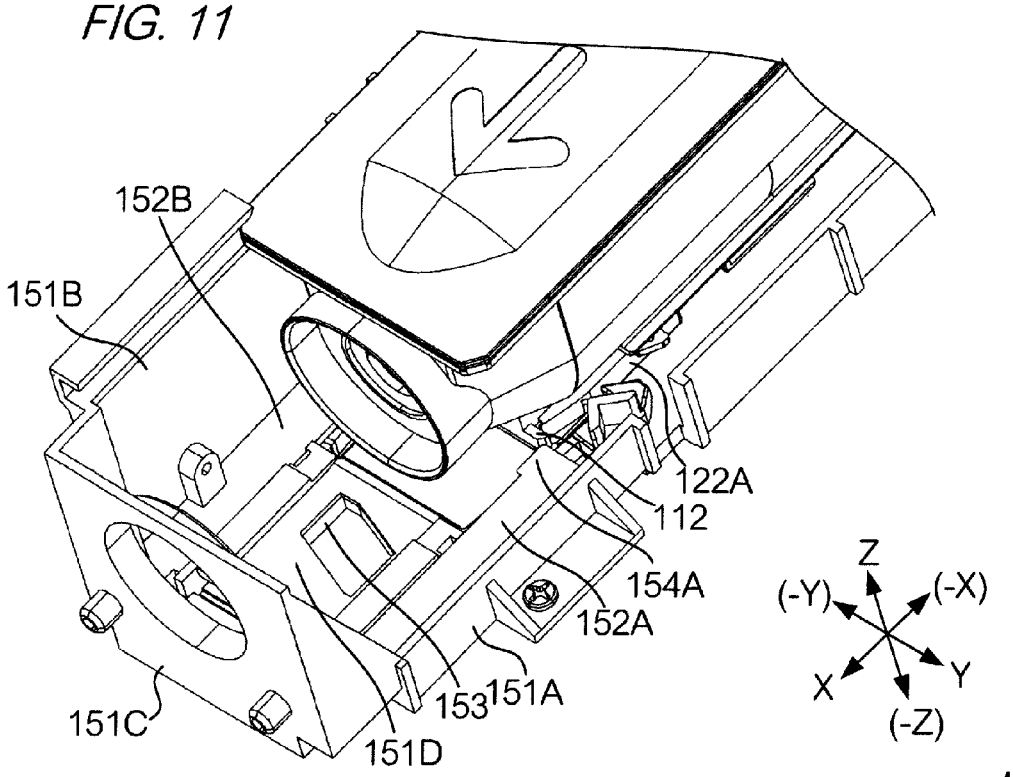
FIG. 11 is an enlarged view showing the front side of toner cartridge 100Y and the front side of toner cartridge docking unit 150Y.

FIG. 11 is an enlarged view showing the front side of toner cartridge 100Y being attached to toner cartridge docking unit 150Y and the front side of toner cartridge docking unit 150Y. FIG. 12 is a diagram illustrating a positional relation between toner cartridge docking unit 150Y and shutter 120 of toner cartridge 100Y positioned as shown in FIG. 11. FIG. 13 is a diagram illustrating a positional relation between toner cartridge docking unit 150Y to which toner cartridge 100Y is attached and shutter 120.

When toner cartridge 100Y is attached to toner cartridge docking unit 150Y, the front side of toner cartridge 100Y is inserted through the back side of toner cartridge docking unit 150Y. After the front end of frame member 111 comes into contact with shutter fixing members 163A and 163B, if toner cartridge 100Y is further inserted into toner cartridge docking unit 150Y, the tip sections of shutter fixing members 163A bow outward as shown in FIGS. 11 and 12.

If toner cartridge 100Y is further inserted into toner cartridge docking unit 150Y, left and right projection portions 112 of frame member 111 enter a space between salients 154A and 154B, and are guided in the forward direction by prevention plates 152A and 152B. Subsequently, the front sides of side walls 122A and 122B of shutter 120 enter the space between salients 154A and 154B, and shutter 120 moves between prevention plates 152A and 152B as toner cartridge 100Y is inserted.

Figure 12:
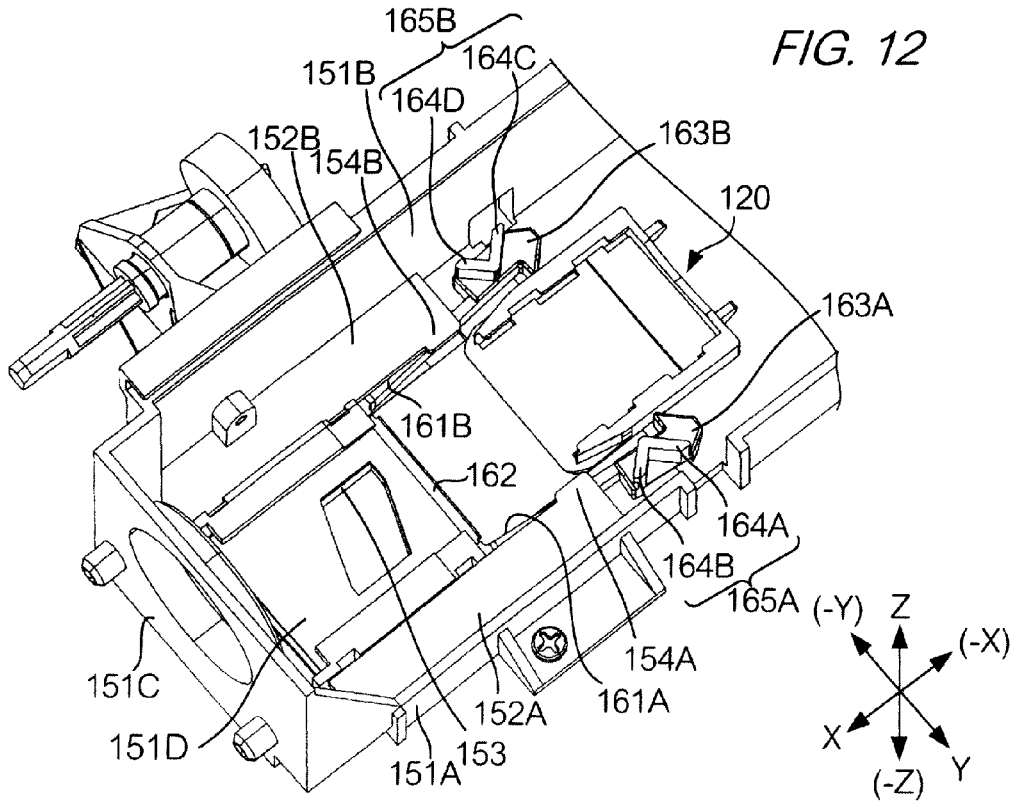
FIG. 12 is a diagram illustrating a positional relation between toner cartridge docking unit 150Y and shutter 120.

If toner cartridge 100Y positioned as shown in FIGS. 11 and 12 is further inserted into toner cartridge docking unit 150Y, arm-opening projection portion 113A comes into contact with wall 164A of arm opening member 165A, and arm-opening projection portion 113B comes into contact with wall 164C of arm opening member 165B. If toner cartridge 100Y is further inserted, arm member 161A is bowed in the right direction by arm-opening projection portion 113A, and arm member 161B is bowed in the left direction by arm-opening projection portion 11 3B.

Figure 13:
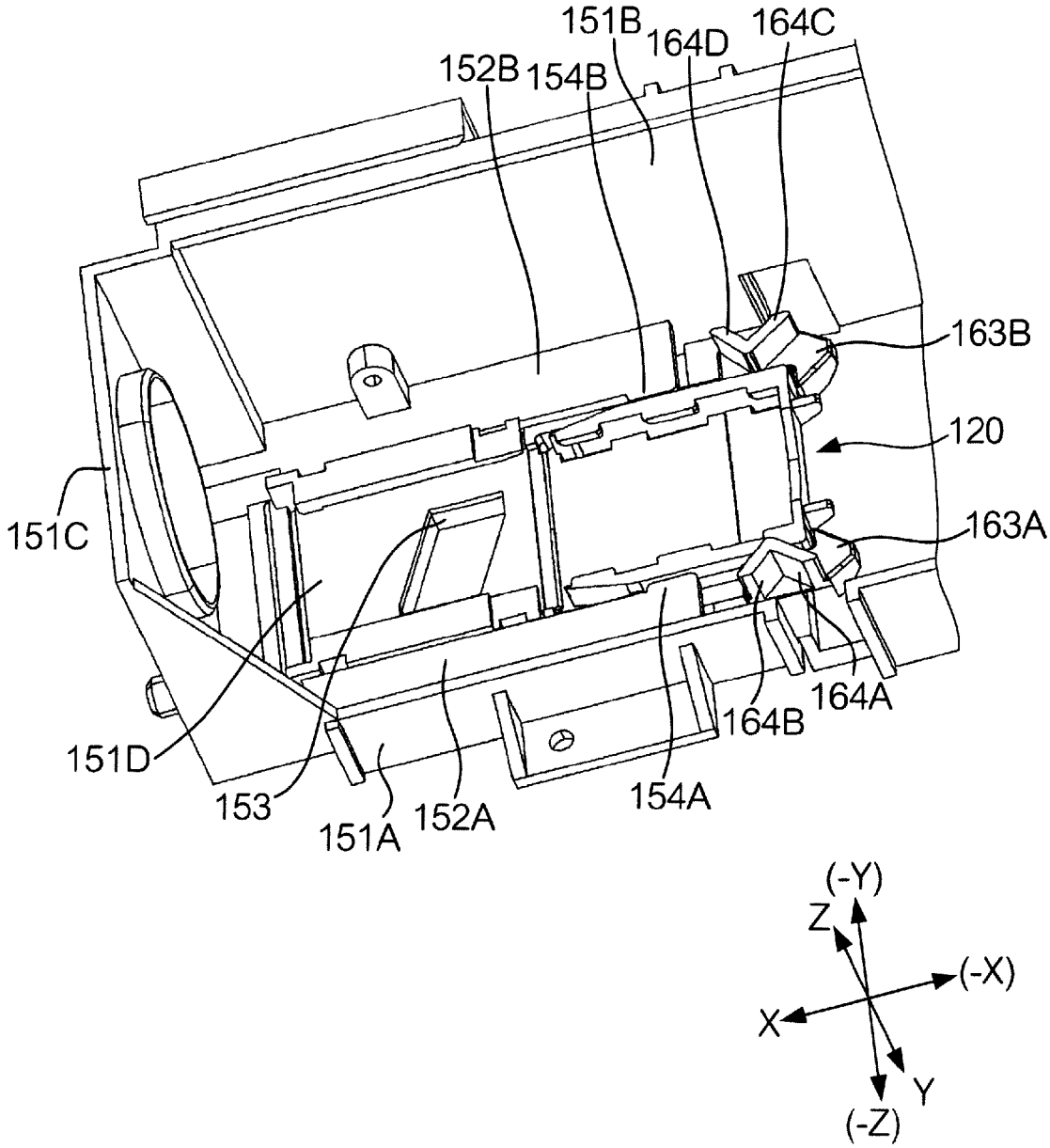
FIG. 13 is a diagram illustrating a positional relation between toner cartridge docking unit 150Y to which toner cartridge 100Y is attached and shutter 120.

If toner cartridge 100Y is further inserted, the front end of bottom wall 121 of shutter 120 comes into contact with toner port forming member 151D, and is fixed as shown in FIG. 13. Toner container 110 moves forward while leaving shutter 120 behind (shutter 120 moves relative to toner container 110), and moves to an open position at which opening 115 is exposed. If toner cartridge 100Y is housed in the housing unit, opening 115 faces toner port 153.

If arm-opening projection portion 113A is moved ahead of wall 164B of arm opening member 165A, and arm-opening projection portion 113B is moved ahead of wall 164D of arm opening member 165B, arm members 161A and 161B which have bowed outward straighten as shown in FIG. 13. As a result, shutter fixing member 163A hangs on the corner formed by side wall 122A and back wall 122C, and shutter fixing member 163B hangs on the corner formed by side wall 122B and back wall 122C, whereby movement of shutter 120 is restricted.

In a case where projection portions 112 are not provided, if toner cartridge 100Y is inserted at a tilt in the horizontal direction, prevention plate 152A may come into contact with side wall 122A, prevention plate 152B may come into contact with side wall 122B, or side walls 122A and 122B may come into contact with a member of the housing unit other than prevention plates 152A and 152B. As a result, shutter 120 may be moved to expose opening 115 while toner cartridge 100Y is being inserted, and toner may be leaked from opening 115.

However, in the present exemplary embodiment, since projection portions 112 are provided ahead of side walls 122A and 122B, there is little chance that prevention plates 152A and 152B come into contact with side walls 122A and 122B. Accordingly, it is unlikely that shutter 120 is moved to expose opening 115 while toner cartridge 100Y is being inserted, and toner is leaked from opening 115.

Also in the present exemplary embodiment, since, while projection portions 112 overlap the ends of side walls 122A and 122B in the vertical direction and the horizontal direction as viewed from the front side, projection portions 112 do not overlap the end of bottom wall 121 either in the vertical direction or the horizontal direction as viewed from the front side, toner port forming member 151D is able to come into contact with bottom wall 121; accordingly shutter 120 can be moved relative to toner container 110.

Also, in a case where the front sides of side walls 122A and 122B are not tapered, if toner cartridge 100Y is inserted at a tilt in the horizontal direction, prevention plate 152A may come into contact with side wall 122A, prevention plate 152B may come into contact with side wall 122B, or side walls 122A and 122B may come into contact with a member of the housing unit other than prevention plates 152A and 152B. As a result, shutter 120 may be moved to expose opening 115 while toner cartridge 100Y is being inserted, and toner may be leaked from opening 115.

However, in the present exemplary embodiment, side walls 122A and 122B are in the horizontal direction tapered towards the front side to have a distance from prevention plate 152A or 152B. Specifically, side wall 122A is formed so that its outside surface opposite to the inside surface facing side wall 122B comes closer to the inside surface, and side wall 122B is formed so that its outside surface opposite to the inside surface facing side wall 122A comes closer to the inside surface. Namely, the width of contact between the end of side wall 122A or 122B and prevention plate 152A or 152B is narrower than that in a case where side walls 122A and 122B are not tapered. Accordingly, there is little chance that side wall 122A or 122B comes into contact with prevention plate 152A or 152B. Also, it is possible to form the end of bottom wall 121, which comes into contact with toner port forming member 151D, widely, as compared with a case in which side walls 122A and 122B are not tapered.

(Operation of Removing Toner Cartridge)

An operation of removing toner cartridge 100Y from toner cartridge applied unit 150Y will be described.

When toner cartridge 100Y being in the situation shown in FIG. 2 is pulled out from toner cartridge applied unit 150Y in the backward direction, since shutter 120 is fixed as shown in FIG. 13, components of toner cartridge 100Y other than shutter 120 are moved in the backward direction, and as a result, the lower side of frame member 111 is covered by shutter 120.

Arm-opening projection portion 113A comes into contact with wall 164B of arm opening member 165A, and arm-opening projection portion 113B comes into contact with wall 164D of arm opening member 165B. In this situation, if toner cartridge 100Y is further pulled out in the backward direction, arm-opening projection portion 113A causes arm member 161A to bow in the right direction, and arm-opening projection portion 113B causes arm member 161B to bow in the left direction. As a result, the hanging on the corner formed by side wall 122A and back wall 122C by shutter fixing member 163A is released, and the hanging on the corner formed by side wall 122B and back wall 122C by shutter fixing member 163B is released, whereby shutter 120 can be moved.

After arm members 161A and 161B bow, if toner cartridge 100Y is further pulled out in the backward direction, back wall 122C of shutter 120 comes into contact with the end face of the back side of frame member 111, and shutter 120 is moved together with frame member 111. If toner cartridge 100Y is further pulled out, toner cartridge 100Y is detached from toner cartridge applied unit 150Y.

In summary, since shutter 120 is fixed until it covers the lower side of frame member 111, and is moved together with frame member 111 after the shutter covers frame member 111, opening 115 is not exposed while toner cartridge 100Y is pulled out. Accordingly, it is prevented that toner flows anywhere other than into toner port 153.

[Modifications]

The above exemplary embodiment of the present invention may be modified as described below.

In the above exemplary embodiment, image-forming device 1 may have not only a copy function but also other functions such as a facsimile function, a scanner function of generating image data representing an image of a document read by reading unit 200, or a function of forming an image on a sheet in accordance with image data sent from a computer.

Also, in the above exemplary embodiment, where the present invention is described using toner cartridge 100Y, which is attached to/removed from an electrophotographic image-forming device, and stores powder toner to be used by a developing device, as an example, the present invention may be applied to other containers for storing supplies to be provided to a device. For example, if sealing performance of members around shutter 120 is enhanced, the present invention may be applied to a container for storing liquid developer. Alternatively, the present invention may be applied to a container for storing ink to be provided to an ink-jet image-forming device.

Also, in the above exemplary embodiment, where side walls 122A and 122B are tapered so that the slope of the tapered wall is linear, as shown in FIG. 5, the slope may be curved.

Also, in the above exemplary embodiment, where side walls 122A and 122C of shutter 120 are integrally formed, and side walls 122B and 122C of shutter 120 are integrally formed, side wall 122C may be formed as a member separated from side wall 122A or 122B.

Figure 14A:
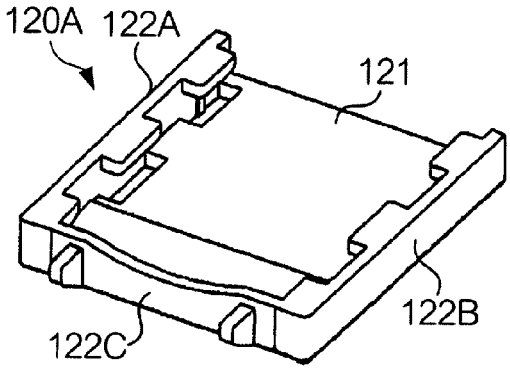
FIG. 14A is an upper side perspective view showing shutter 120A according to a modification of the present invention.
Figure 14B:
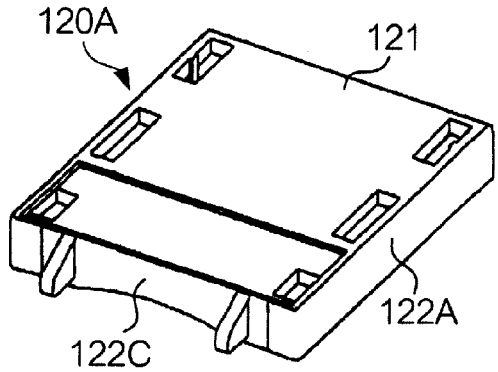
FIG. 14B is an under side perspective view showing the same shutter.

Also, in the above exemplary embodiment, where the front side of side walls 122A and 122B, and bottom wall 121 of shutter 120 are tapered, side walls 122A and 122B, and bottom wall 121 do not have to be tapered, as shown in FIGS. 14A and 14B.

Figure 15:
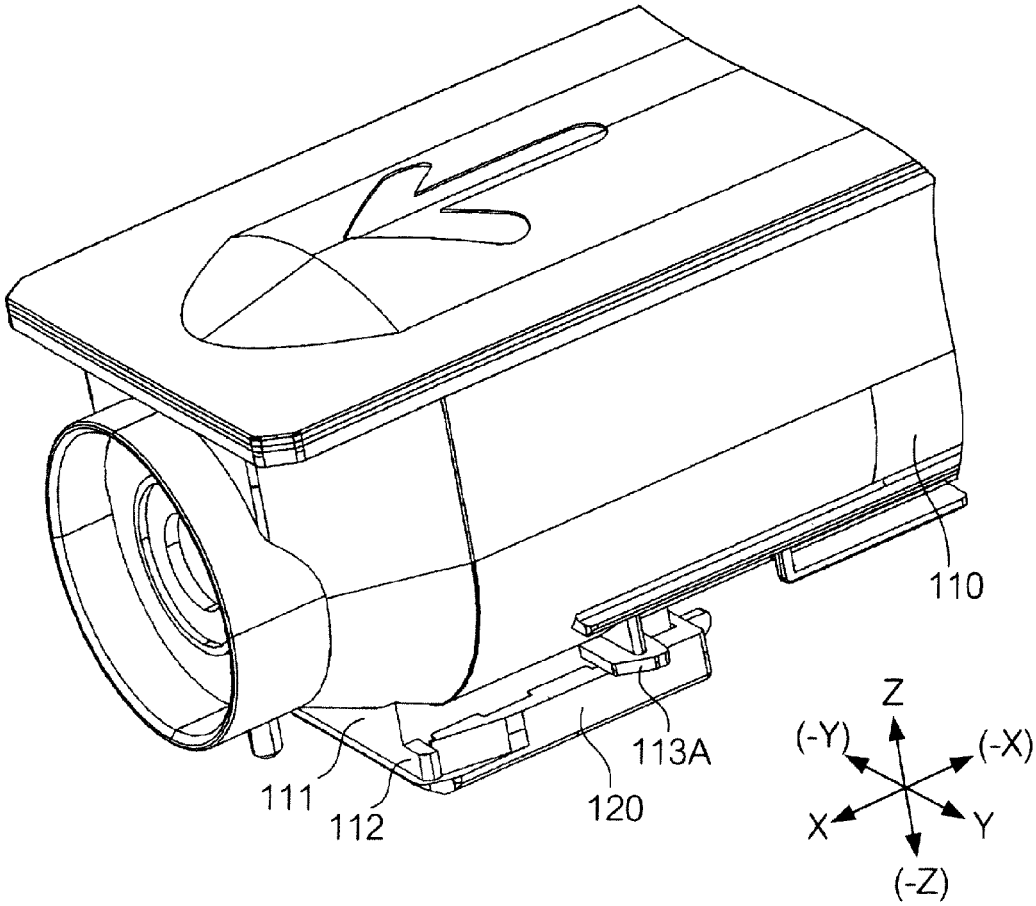
FIG. 15 is an enlarged view showing the front side of toner cartridge 100Y according to a modification of the present invention.

Also, in the above exemplary embodiment, the length in the horizontal direction of projection portions 112 may be shorter than that of projection portions 112 shown in FIG. 4, as shown in FIG. 15, as long as projection portions 112 are able to prevent the front side of side walls 122A and 122B from coming into contact with salients 154A and 154B.

Also, in the above exemplary embodiment, contact between the front end of shutter 120 and salient 154A or 154B may be prevented without using projection portions 112.

Figure 16:
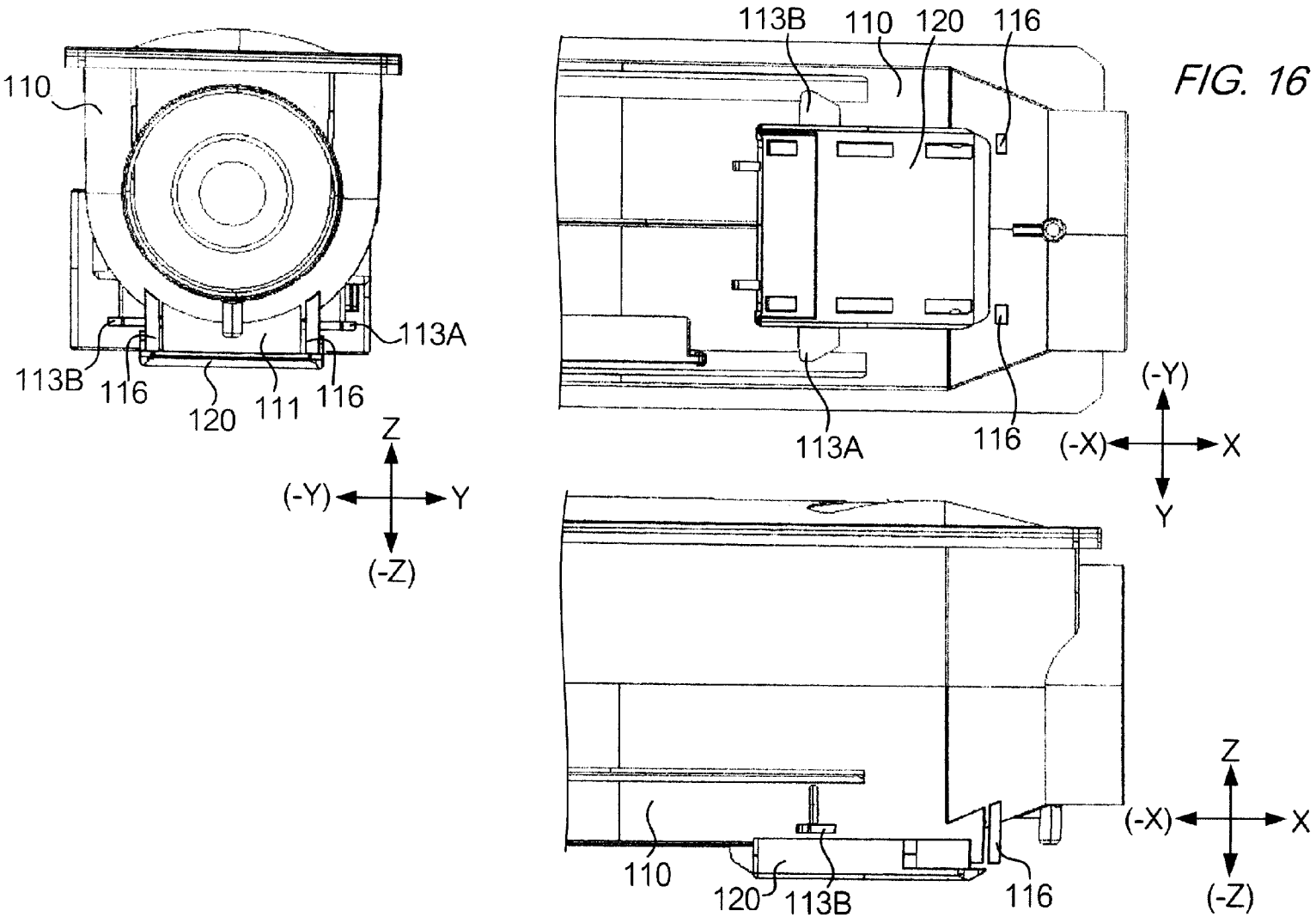
FIG. 16 is three orthogonal views showing the front side of toner cartridge 100Y according to a modification of the present invention.

For example, instead of projection portions 112, columnar protection portions 116 that protrude in the downward direction from toner container 110 as shown in FIG. 16 may be provided in front of frame member 111.

Figure 17:
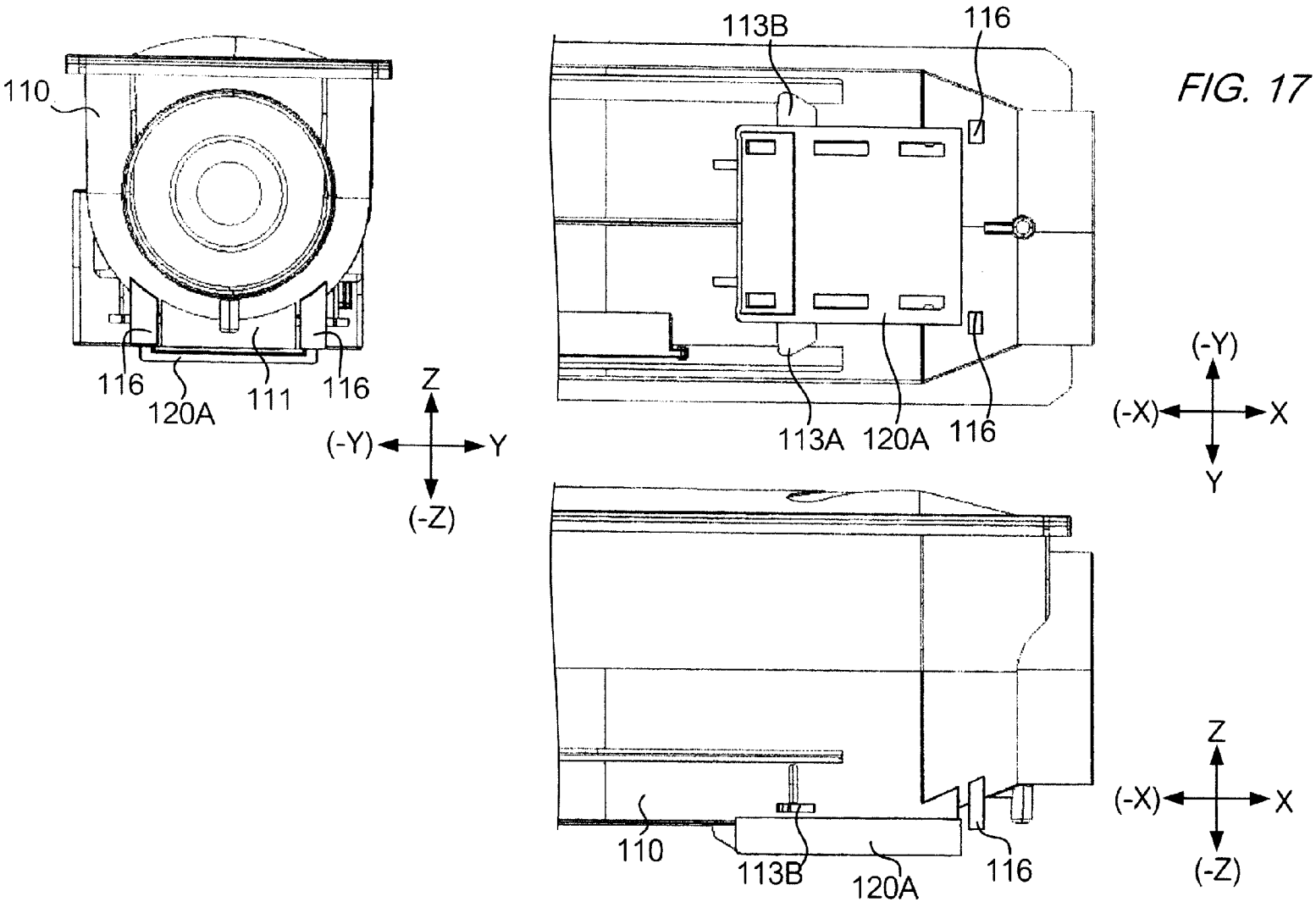
FIG. 17 is three orthogonal views showing the front side of toner cartridge 100Y according to a modification of the present invention.

Columnar protection portions 116 may be provided as shown in FIG. 17, if shutter 120A shown in FIG. 14 is used instead of shutter 120.

Figure 18:
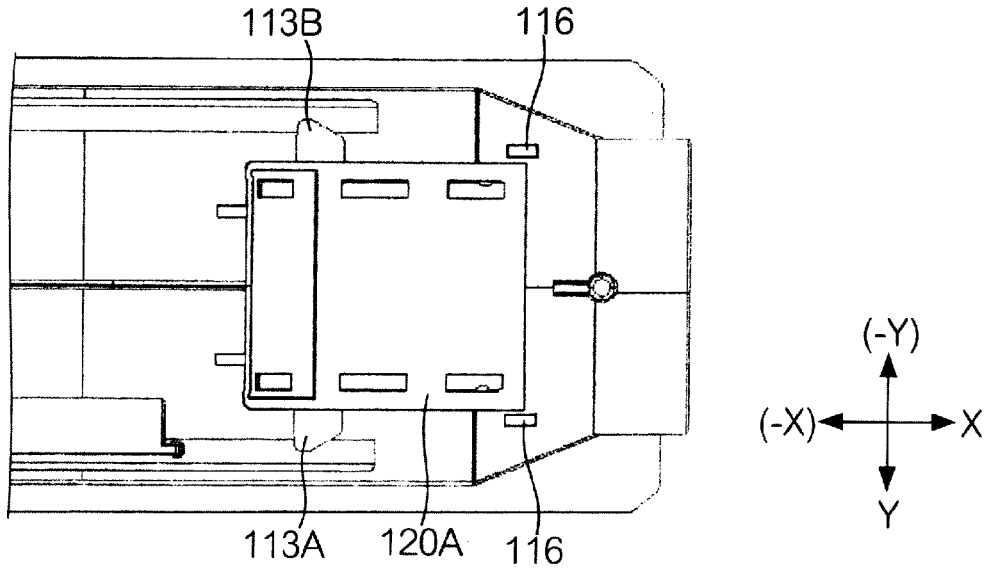
FIG. 18 is a bottom view showing the front side of toner cartridge 100Y according to a modification of the present invention.

If shutter 120A is used, alternatively, columnar protection portions 116 may be provided on either side of frame member 111, as shown in FIG. 18.

It is to be noted that the front side of protection portions 116 shown in FIGS. 14 to 18 may be tapered, and the width in the horizontal direction becomes narrower toward the front side, as in the case of shutter 120.

Also, in the above exemplary embodiment, where the housing unit includes prevention plates 152A and 152B, and salients 154A and 154B, and where projection portion 112 is provided on either side of frame member 111, only prevention plate 152A and salient 154A may be provided, and projection portion 112 may be provided on only the right side of frame member 111. Alternatively, only prevention plate 152B and salient 154B may be provided, and projection portion 112 may be provided on only the left side of frame member 111.

Figure 19:
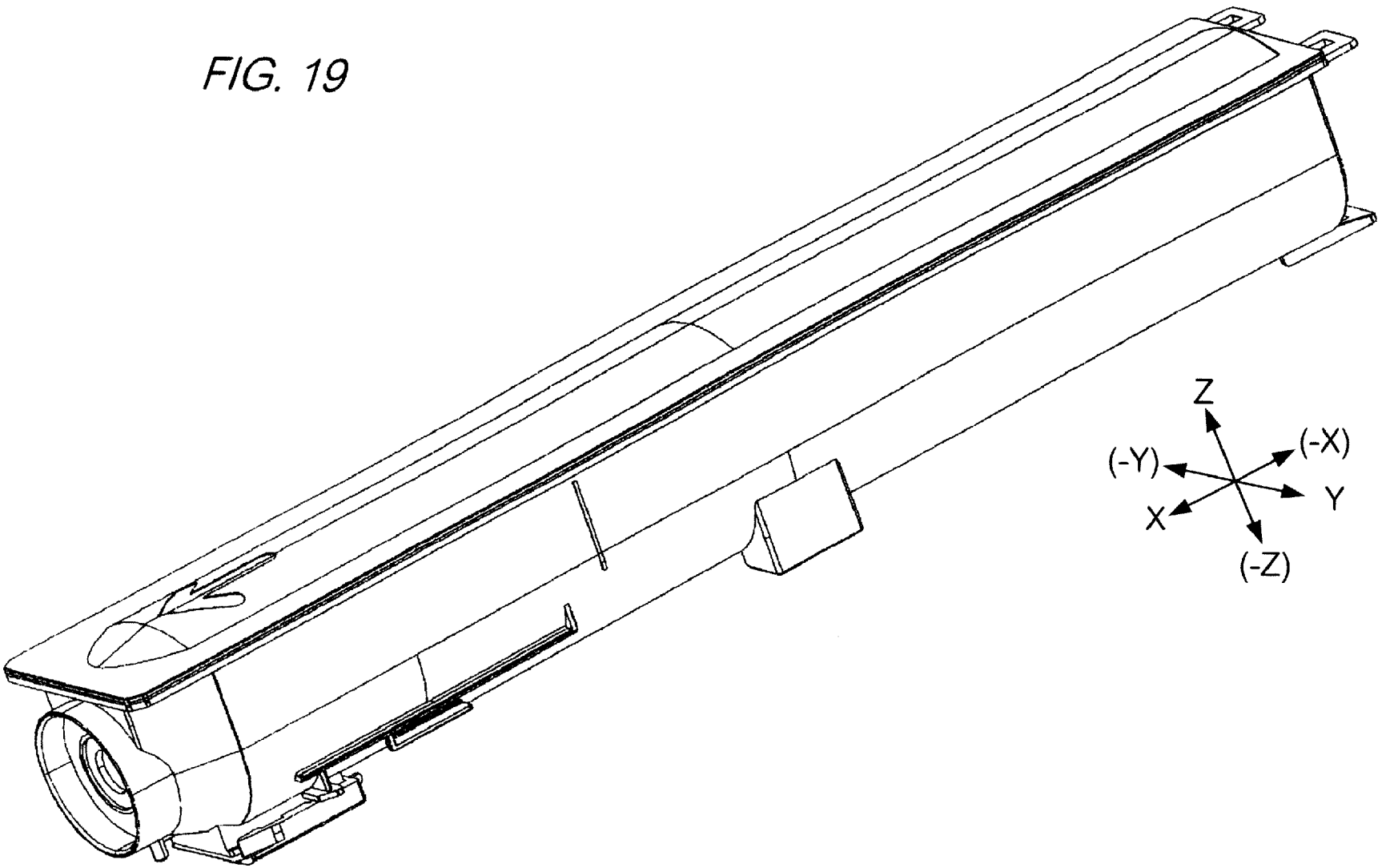
FIG. 19 is an external view showing toner cartridge 100Y according to a modification of the present invention.

Also, in the above exemplary embodiment, where toner cartridge 100Y has projection portions 112 as shown in FIG. 4, toner cartridge 100Y does not have to have projection portions 112 as shown in FIG. 19.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A container comprising:

a container body that stores supplies to be provided to a device, that is to be inserted into the device, and that has a port out of which the supplies flow; and a pair of support members arranged so that the support members face each other across the port, that supports an openable and closable cover for covering the port so that the openable and closable cover is able to move between a closed position at which the port is covered and an open position at which the port is exposed, the openable and closable cover including:

a covering portion that covers the port at the close position;

a pair of supported members that are supported by the support members; and a pair of connecting portions arranged so that the connecting portions face each other, and connects the covering portion and the supported members, and at least one of the connecting portions being configured so that the connecting portion becomes narrow as an outside surface of the connecting portion tapers towards its inside surface at an end of the container body inserted into the device.

2. The container according to claim 1, further comprising a protection portion provided on the container body in a side of an insert direction in which the container body is inserted into the device, relative to the openable and closable cover, that prevents a member inside the device from coming into contact with ends in a side of the insert direction of the connecting portions, while allowing a contact member inside the device to come into contact with the covering portion, the contact member moving the openable and closable cover by coming into contact with an end in a side of the insert direction of the covering portion.

3. The container according to claim 2, wherein the protection portion is formed so that the protection portion allows the outside surface of the connecting portion to be seen from a side of the insert direction, while not allowing the ends in a side of the insert direction of the connecting portions to be seen from a side of the insert direction.

4. The container according to claim 1, wherein leading ends of the pair of connecting portions taper toward a longitudinal axis of the covering portion and are located within a periphery of the covering portion.

5. A container comprising:

a container body that stores supplies to be provided to a device, that is to be inserted into the device, and that has a port out of which the supplies flow; and a pair of support members arranged so that the support members face each other across the port, that supports an openable and closable cover for covering the port so that the openable and closable cover is able to move between a closed position at which the port is covered and an open position at which the port is exposed, the openable and closable cover including:

a covering portion that covers the port at the closed position;

a pair of supported members that are supported by the support members;

a pair of connecting portions arranged so that the connecting portions face each other, and connects the covering portion and the supported members, and at least one of the connecting portions being configured so that the connecting portion becomes narrow as an outside surface of the connecting portion tapers towards its inside surface at an end of the container body inserted into the device; and a protection portion provided on the container body in a side of an insert direction in which the container body is inserted into the device, relative to the openable and closable cover, that prevents a member inside the device from coming into contact with ends in a side of the insert direction of the connecting portions, while allowing a contact member inside the device to come into contact with the covering portion, the contact member moving the openable and closable cover by coming into contact with an end in a side of the insert direction of the covering portion.

6. The container according to claim 5, wherein at least one of the connecting portions is configured so that the connecting portion becomes narrow as an outside surface of the connecting portion tapers towards its inside surface at an end of the container body inserted into the device.

7. The container according to claim 6, wherein the protection portion is formed so that the protection portion allows the outside surface of the connecting portion to be seen from a side of the insert direction, while not allowing the ends in a side of the insert direction of the connecting portions to be seen from a side of the insert direction.

8. A device comprising:

a container comprising:

a container body that stores supplies to be provided to the device, that is to be inserted into the device, and that has a port out of which the supplies flow; and a pair of support members arranged so that the support members face each other across the port, that supports an openable and closable cover for covering the port so that the openable and closable cover is able to move between a closed position at which the port is covered and an open position at which the port is exposed, the openable and closable cover including:

a covering portion that covers the port at the closed position;

a pair of supported members that are supported by the support members; and a pair of connecting portions arranged so that the connecting portions face each other, and connects the covering portion and the supported members, and at least one of the connecting portions being configured so that the connecting portion becomes narrow as an outside surface of the connecting portion tapers towards its inside surface at an end of the container body inserted into the device;

a fixing member provided on the device, that fixes the openable and closable cover of the container inserted into the device at the open position; and a prevention member arranged between the container body of the container inserted into the device and the fixing member, that prevents the fixing member from moving in a direction perpendicular to the direction in which the openable and closable cover is moved, the prevention member being arranged in correspondence with the connecting portion.

9. A device comprising:

a container comprising:

a container body that stores supplies to be provided to the device, that is to be inserted into the device, and that has a port out of which the supplies flow; and a pair of support members arranged so that the support members face each other across the port, that supports an openable and closable cover for covering the port so that the openable and closable cover is able to move between a closed position at which the port is covered and an open position at which the port is exposed, the openable and closable cover including:

a covering portion that covers the port at the closed position;

a pair of supported members that are supported by the support members;

a pair of connecting portions arranged so that the connecting portions face each other, and connects the covering portion and the supported members, and at least one of the connecting portions being configured so that the connecting portion becomes narrow as an outside surface of the connecting portion tapers towards its inside surface at an end of the container body inserted into the device;

a protection portion provided on the container body in a side of an insert direction in which the container body is inserted into the device, relative to the openable and closable cover, that prevents a member inside the device from coming into contact with ends in a side of the insert direction of the connecting portions, while allowing a contact member inside the device to come into contact with the covering portion, the contact member moving the openable and closable cover by coming into contact with an end in a side of the insert direction of the covering portion;

a fixing member provided on the device, that fixes the openable and closable cover of the container inserted into the device at the open position; and a prevention member arranged between the container body of the container inserted into the device and the fixing member, that prevents the fixing member from moving in a direction perpendicular to the direction in which the openable and closable cover is moved.

* * * * *